United States Patent [19]

Bachley

[11] 4,202,111

[45] May 13, 1980

[54] DRAFTING APPARATUS

[76] Inventor: Peter V. Bachley, 473 St. Helene St., Apt. 211, Longueuil, Quebec, Canada

[21] Appl. No.: 850,677

[22] Filed: Nov. 11, 1977

Related U.S. Application Data

[63] Continuation-in-part of Ser. No. 696,386, Jun. 15, 1976, abandoned, which is a continuation-in-part of Ser. No. 599,966, Jul. 29, 1975, abandoned.

[51] Int. Cl.[2] ..... B43L 13/02

[52] U.S. Cl. ..... 33/444; 242/67.1 D; 24/33 B

[58] Field of Search ..... 33/76 R, 79 R, 80, 444; 312/231; 108/5 D; 242/67.1 D; 24/33 B

[56] References Cited

U.S. PATENT DOCUMENTS

| | | | |
|---|---|---|---|
| 1,477,409 | 12/1923 | Woolman | 312/231 |
| 1,506,489 | 8/1924 | Kiefer | 24/33 B |
| 2,622,364 | 12/1952 | Hine | 242/61.7 D |
| 2,696,415 | 12/1954 | Himelson | 312/231 X |
| 3,108,028 | 4/1965 | Roccati | 33/79 |
| 3,330,580 | 7/1967 | Vanek | 108/50 X |
| 3,630,588 | 12/1971 | Baker | 312/231 |
| 3,669,227 | 6/1972 | Alford | 312/231 X |
| 4,200,173 | 2/1978 | Closterman | 312/231 |

*Primary Examiner*—Charles E. Phillips
*Attorney, Agent, or Firm*—Swabey, Mitchell, Houle, Marcoux and Sher

[57] ABSTRACT

A drafting aid comprising a flat board, the board having two straight parallel edges and guide surfaces at the parallel edges. A flexible member passes about the board and over the guide means. The flexible member includes resilient tension members extending between the end edges thereof to form a taut member about the board.

1 Claim, 10 Drawing Figures

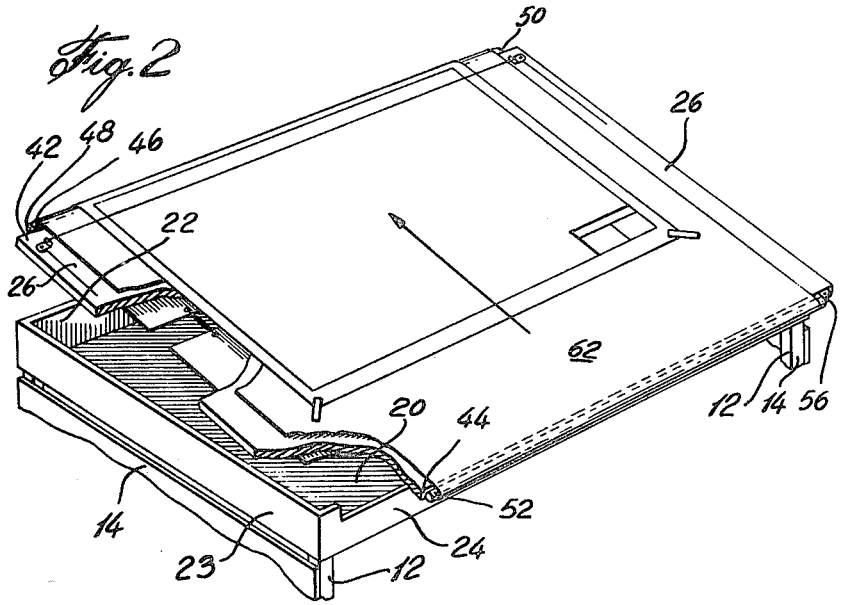
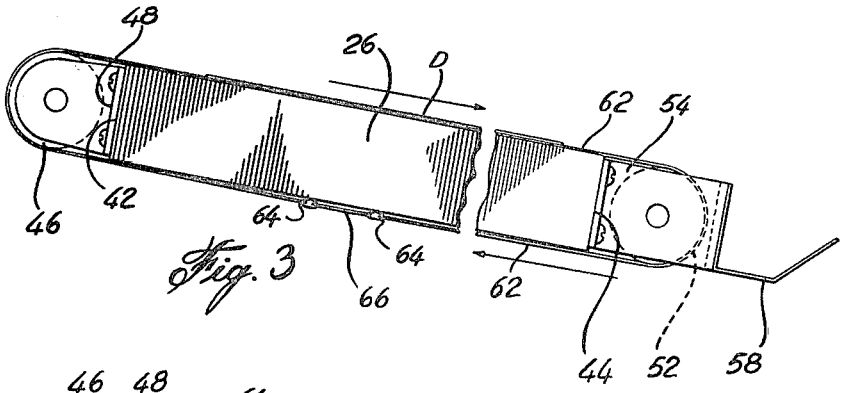
Fig. 3
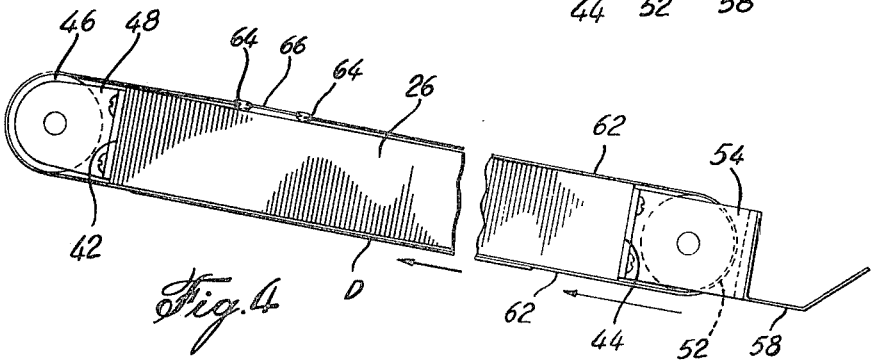
Fig. 4

DRAFTING APPARATUS

CROSS-REFERENCE TO RELATED APPLICATION

This application is a continuation-in-part of United States application, Ser. No. 696,386, filed June 15, 1976, which is a continuation-in-part of United States application, Ser. No. 599,966, filed July 29, 1975, both abandoned.

BACKGROUND OF THE INVENTION

1. Field of the Invention

This invention is directed toward improvements in drawing systems. The invention is more particularly directed toward improvements in drawing systems of the type employing drawing or drafting boards.

2. Description of the Prior Art

Drawing or drafting boards are employed to provide a large, flat, rectangular working surface when drawing or drafting. A sheet of drawing paper is attached by tape or other suitable fastening means to the working surface of the board. If the drawing on the paper is not completed during a working session, the paper is usually removed from the working surface of the board and stored to protect the drawing. When further work is to be done on the drawing, it must be squared and remounted on the working surface.

U.S. Pat. No. 3,180,028, Roccati, 1965, illustrates a continuous conveyor type belt mounted on large rollers and sliding on a drawing board. One of the rollers is coupled to a parallel shaft and to a drive sleeve. The conveying surface is connected at its lateral edges by means of a perforated rubber strip. The size of the rollers also reduces the draftsman's accessibility to the drawing board. The connection, as shown in the Roccati patent, has very little elastic play and cannot be easily removed or cannot be easily re-aligned in order to place the conveying band properly on the drawing table. It has been found that if small diameter rollers are used at each end of the board, the unsupported span over which such rollers extend will cause deflection in most rollers, thereby causing the distance between the axes of the rollers at the center of the board to be less than the distance between the axes of the rollers near the supported ends of the rollers. Further, varying temperatures may affect different areas of the conveyor band at different time periods.

SUMMARY OF THE INVENTION

It is an aim of the present invention to provide a drawing device which has an improved conveying band mounted on smaller and less cumbersome rollers at opposite ends of the drafting board. Accordingly, it is also an aim of the present invention to eliminate the necessity of the additional drive sleeve.

It is an aim of the present invention to provide independent, individual tension means, spaced apart and parallel, extending between the lateral edges of the conveyor such that similar equal tensions can be applied at different longitudinal areas of the conveyor band even though such different areas may be subject to varying conditions caused by the bowing or deflection of the rollers and by temperatures, for instance.

In one embodiment of the invention, a drawing aid for a drawing board, having a working surface, is provided, which aid comprises a flexible member providing a drawing surface and means for mounting the flexible member on the drawing board so that the flexible member can be moved relative to the board working surface. The flexible member substantially encircles the board and passes about a pair of substantially parallel rollers mounted on opposed edges of the drawing board. The rollers may have a diameter approximating the thickness of the board. The flexible member is rectangular in shape and has spaced-apart parallel edges which are drawn together by means of elongate tension members spaced apart and parallel and, of course, at right angles to the edges of the flexible member. These conveyor members are resilient and provide equal tension subject to varying conditions on the flexible member.

In use, a drawing sheet is mounted on the drawing surface of the flexible member, over the working surface of the drawing board. If work on the sheet must be interrupted, the flexible conveyor member is moved about the rollers to store the drawing sheet under the board until work can be continued, at which time the flexible member is again moved about the rollers to bring the sheet back onto the top of the board working surface.

The flexible conveyor member can be formed with one or more loops under the drawing board to increase its length and, thus, accommodate drawing papers of a length several times greater than that of the drawing board.

A drafting aid including a flexible member is such that it allows the area of the drawing to be placed in a convenient position for the draftsman. The flexible member can easily be re-aligned on the drafting table by merely moving one edge of the flexible member laterally and rolling the member until the band follows and realigns itself under tension. Improved tension adjustment is provided by varying the elongated resilient members extending between the band.

A drafting table is also provided incorporating a drawing board having the drawing aid of the present invention, in which a top surface having peripheral walls defining a tray is provided, and the drawing board is hinged from one of the peripheral walls adapted to be superimposed from the tray, cantilevered panels hinged to other peripheral walls of the tray, at least a channel member fixed to the drawing board spaced from the edge a distance sufficient to clear the roller and the flexible member, means adapted to support the drafting table in an upward working position at an angle to the table and a closed position covering the tray.

In a further embodiment of the present invention, there is provided a guide for a parallel straight edge including a spring-loaded taut flexible member, pulleys provided near the corners of the drawing board on which the flexible member is trained and anchor means associated with the pulleys for fixing the flexible member against movement, said anchor means being associated with at least one of said pulleys and including a base plate having an edge engaging said flexible member to cause a sharp change of direction in said flexible member.

The overall combined structure of the drafting table described provides many advantages other than those mentioned above, including easy finger-tip control of the flexible conveyor sheet, and a utility pencil tray in the form of a channel spaced such that it can serve as a travel rail for a vertical drafter, thus eliminating the necessity for the conventional travel on the board of the vertical drafter, thus leaving undesirable marks on the drawing surface.

An improved parallel straight edge system eliminates the conventional fixed adjustment which has been found to damage the flexible member. The drafting table also provides a drawing storage compartment as well as a builtin bookshelf.

BRIEF DESCRIPTION OF THE DRAWINGS

Having thus generally described the nature of the invention, reference will now be made to the accompanying drawings, showing by way of illustration, a preferred embodiment thereof, and in which:

FIG. 2 is a fragmentary perspective view, partly in cross-section, showing certain features of the drafting table;

FIG. 3 is an enlarged fragmentary view in side elevation of a detail of the drafting board;

FIG. 4 is a view similar to FIG. 3 showing a different operating position thereof;

DESCRIPTION OF THE PREFERRED EMBODIMENTS

Figure 1:
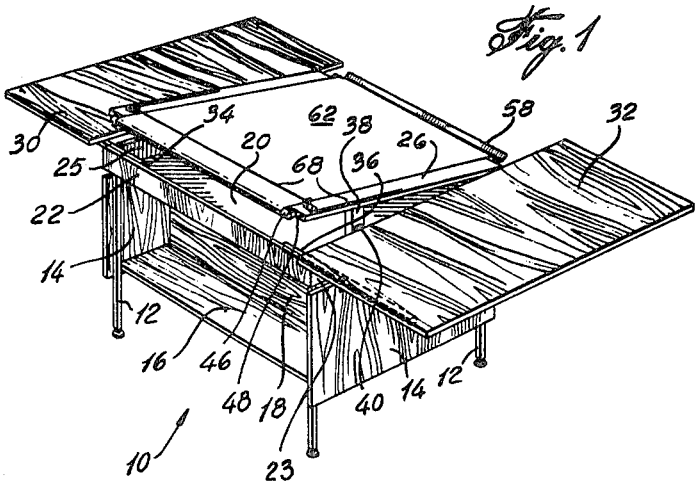
FIG. 1 is a perspective view of a drafting table incorporating all of the embodiments of the present invention.
Figure 5:
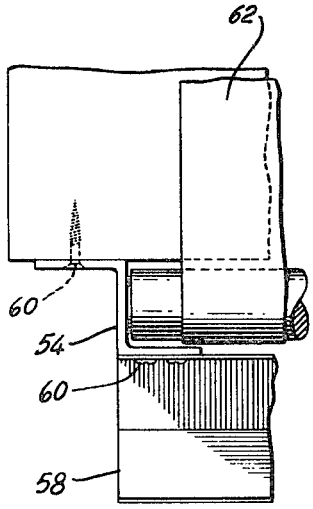
FIG. 5 is an enlarged fragmentary view showing a further detail of the table.

Referring now to the drawings, and especially to FIG. 1, there is shown a table 10 having upstanding legs 12 to which are attached side walls 14. The table includes top wall 20, bottom wall 16 and a vertical intermediate wall 18 which can be displaced to provide a library shelf as shown, or for access from the opposite side of the table. Peripheral upstanding shallow walls 22, 23, 24, and 25 surround the top wall 20 forming a compartment or tray. The drafting board 26 is hinged by a pair of hinges (not shown) to the wall 24. On either side of the drafting table are provided cantilevered hinged reference panels 30 and 32. Sliding pins 34 and 36 respectively are adapted to protrude outwardly from the wall 22 in order to support the reference panels 30 and 32 respectively when these panels are in a horizontal position.

Short support members 38 are hinged at 40 to the walls 23 and 25 so as to support the drafting board 26 at an angled position as shown in FIG. 1. When the drafting table is not in use, the support members 38 can be pivoted inwardly of the tray so as to allow the drafting board 26 to close the top of the tray.

The drafting board, as shown in FIGS. 2 to 4, includes edges 42 and 44 to which are mounted idler rollers 46 and 52 respectively by means of brackets 48 and 50 and 54 and 56. The rollers 46 and 52 would have a diameter not less than the thickness of the board such that the flexible band will be parallel on both sides of the board in planes tangent to the rollers 46 and 52. The diameter would not be much greater since it would impede the accessibility to the draftsman. Near the edge 44 and mounted to the bracket 52 is a channel-shaped pencil tray 58. The pencil tray 58 is spaced from the edge 44 in order to allow passage of the flexible conveyor sheet 62.

Figure 7:
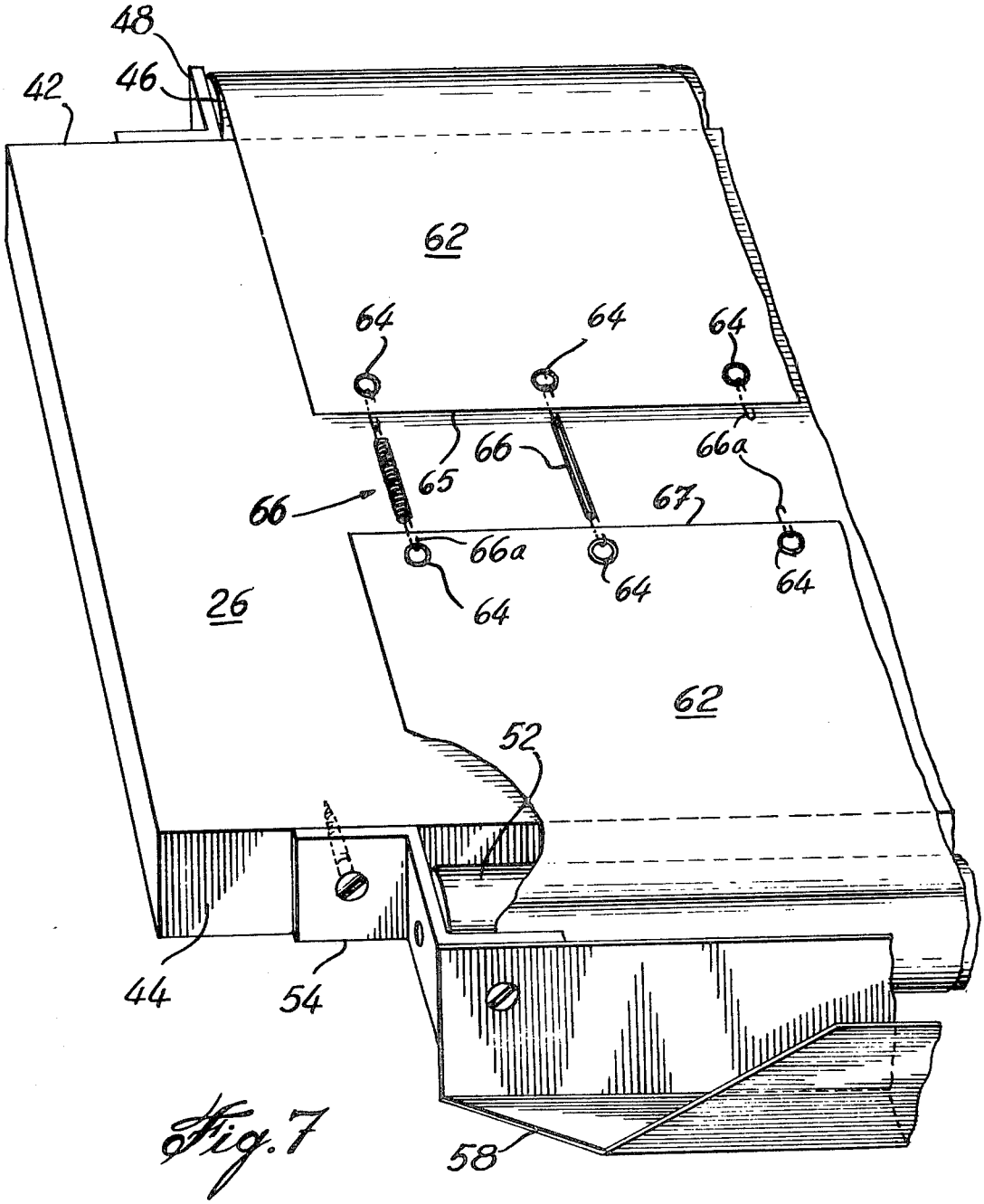
FIG. 7 is a fragmentary perspective view of a detail of the present invention.

The conveyor sheet 62 is preferably made out of a transparent polyester film, such as that available under the trade mark "Mylar" sold by Du Pont of Canada Limited. The conveyor sheet 62 is rectangular in shape and is tightly drawn about the drafting board 26 over the rollers 46 and 52 and has its end edges 65, 67 parallel to each other and closely adjacent. A row of reinforced eyelets 64 is provided near the edges 65, 67 of the conveyor sheet 62 and a number of resilient tension members 66 are connected through the eyelets 64 to tension the conveyor sheet 62. The tension members 66 are shown in FIG. 7 as made of rubber and also as a steel coil spring. They can, of course, be made of other resilient material. The spacing of the tension members 66 varies, and in the present case, are closer together near the edges in order to keep the conveyor member under tension even in the center areas where the rollers may be bowed inwardly; or it could be reversed with the spacing greater near the edges.

It is also contemplated adding a strip of velvetlike material to the underside of the flexible conveyor sheet 62 near the lateral edges thereof in order to sweep the table clean of debris.

A sheet of drawing paper can be mounted on the conveyor sheet 62 by means of suitable tape or other fastening means. If it is necessary to move the drawing sheet D to a more convenient drafting position, or if it is necessary to store a drawing sheet which has not yet been completed, it is merely necessary to move the conveyor sheet 62 by finger pressure, so that the conveyor sheet and the drawing sheet will pass about the rollers 46 or 52 and underneath the drafting board 26 to a stored position within the tray formed by the upper wall 20 of the drafting table and the peripheral walls 22, 23, 24 and 25. FIGS. 2, 3, and 4 show this operation.

Figure 10:
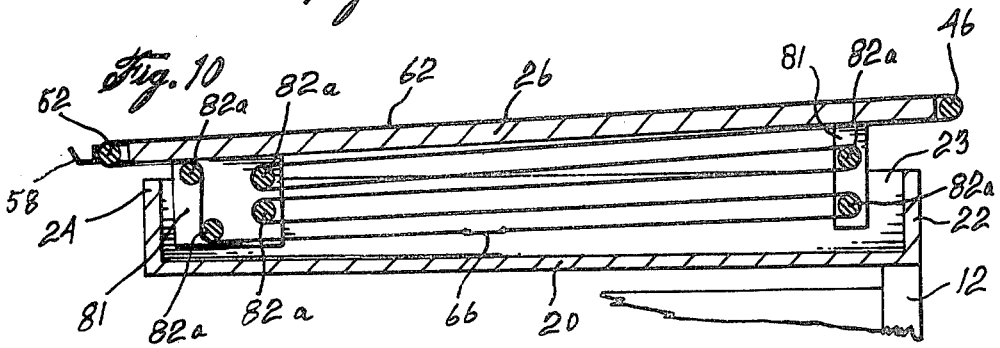
FIG. 10 is a section of another embodiment of the drafting table showing several loops of the flexible member to increase its effective length.

In order to increase the effective length of the flexible conveyor sheet 62, the drafting board 26 of FIG. 10 is provided, on each side, with downwardly extending lateral supports 81 between which extend and in which are journalled several transversely extending rollers **82*a* parallel to the rollers 46 and 52**.

Rollers **82*a* are arranged such that the conveyor sheet 62, when trained thereover, will make one or more additional loops underneath the drafting board 26. Therefore, a much longer sheet of drawing paper can be affixed to the conveyor band 62 than is possible when this band makes only one loop around the drafting board 23**, as in the first embodiment.

Figure 8:
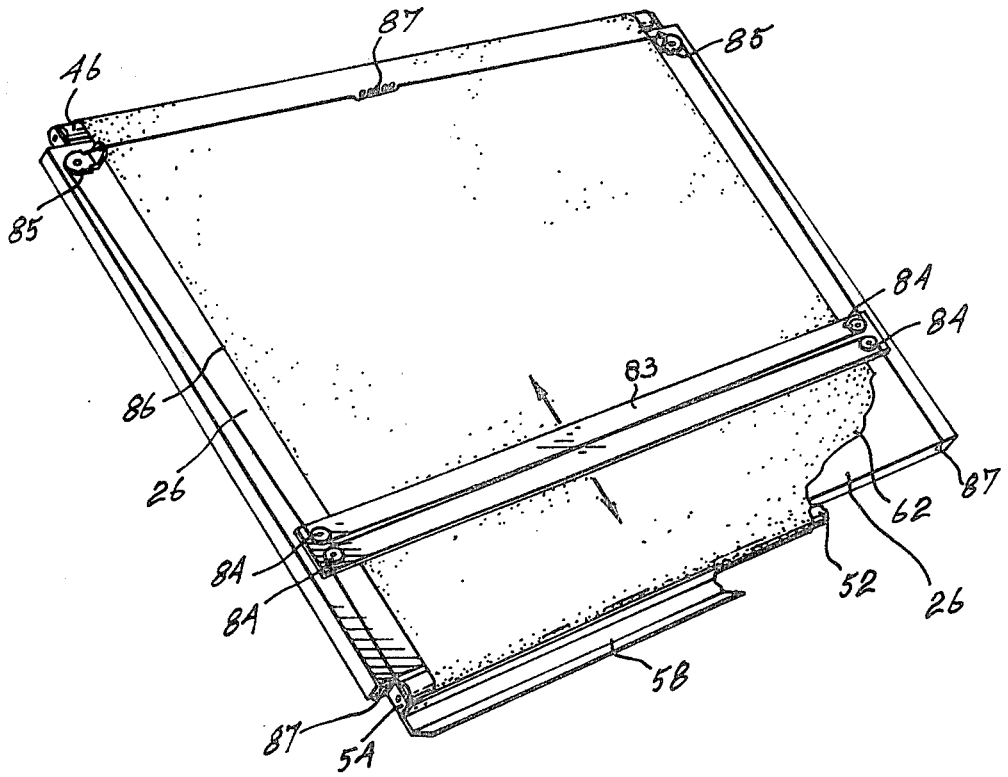
FIG. 8 is a perspective view, partially cut away of the drafting board and the parallel straight edge system of the invention.

If it is necessary to use a parallel straight edge travelling on taut cords on either side of the drafting table, the arrangement shown in FIG. 8 is preferred, wherein the straight edge 83 is provided in the usual manner with a pair of pulleys 84 at each end thereof, while a corner pulley 85 is rotatably mounted at each top corner of the drafting board 26 in the usual manner.

A flexible cable 86 is trained on pulleys 84, 85 and the outer ends of the cables are anchored at 87 to the bottom corners of the drafting board. The cable 86 is crossed in the middle of the straight edge 83, in conventional manner, so that the latter can move up and down the drafting board while remaining parallel to itself. The cable 86 does not move on pulleys 85 and is normally anchored down at one of the pulleys 85 by means of a headed screw. Whenever it is desired to adjust the inclination of the straight edge 83 with respect to the drafting board, the cable anchoring screw is untightened and the top run of cable 86 is displaced across the board, while moving on pulleys 85, until the proper inclination of the straight edge has been obtained. Then the headed anchoring screw is tightened down on the cable. This screw has been found to damage the cable.

Figure 9:
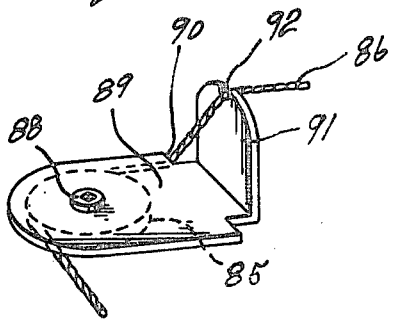
FIG. 9 is a perspective view of another embodiment of the combined pulley and cable anchoring means for the straight edge travelling system of the invention.

In accordance with the invention, the top run of the cable is made of two cable sections attached to the ends of a tension spring 87 and the pulley 85 is journalled on a screw 88 underneath cable anchoring plate 89. The screw 88 fixes base plate 89 to drafting board 26. As shown in FIG. 9, plate 89 is provided with a shoulder 90 at least along one side edge and with upstanding member 91 at one end. Member 91 has a central notch 92 at its top edge. Both pulleys 85 are provided with a plate 89, and the upstanding members 91 face each other, being directed towards the center of the drafting board. For that purpose, base plate 89 has a shoulder 90 on each side, so as to be symmetrical. The cable 86 is engaged by shoulder 90 and notch 92; it is thus anchored against movement on the pulleys 85, because it is submitted to at least one sharp change of direction by being engaged by one edge of the anchor device. In the particular system, the cable is engaged by the edge formed by shoulder 90 and by the edge at the bottom of the top notch 92. The upstanding member 91 serves also to space the cable above the drafting board 26 to allow the flexible conveyor sheet 62 and the drawing sheet D to pass underneath. Whenever it is desired to adjust the inclination of the straight edge 83, one section of the top run of the cable is pulled against the action of the tension spring 86 and the cable is disengaged from shoulders 90 and notches 92 of the two anchoring devices, whereby the cable is free to move around the pulleys 85. Once the straight edge has been adjusted, the cable is again made to engage the shoulder and top notch of both anchoring devices.

Figure 6:
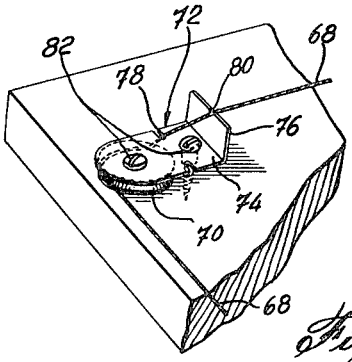
FIG. 6 is an enlarged fragmentary perspective view of another feature thereof.

As a modification, FIG. 6 shows one of the top corner pulley system 72 including the pulley 70, on which the cable 68 is trained. The pulley 70 is rotatably mounted underneath the base plate 74, being journalled on one of the two screws 82 serving to fix the base plate 74 to the drafting board. Base plate 74 has a side notch 78 through which the cord 68 can pass when it is locked and an upstanding member 76 including a top notch 80 for receiving the cord 68 and space it above the drafting table to allow the flexible conveyor sheet 62 and the drawing sheet D to pass underneath. There again, the notches 78 and 80 provide two edges engaging the cable and causing abrupt change of direction of the same to prevent movement of the cable on the pulley 70. It is again an easy matter to pull on the top run of the cable 68 to elongate tension spring 86, so as to disengage the cable from the two notches 78 and 80 at each top corner of the drafting board to permit free movement of the cable around the pulleys 70 and consequent angular adjustment of the straight edge 83.

I claim:

1. A drafting table comprising a flat board and a flexible member travelling about the board, the board having two straight parallel edges, an idler roller at each parallel edge and at right angles to the travel of the flexible member, the flexible member passing about the board over the idler rollers and kept taut, the flexible member being such that a drawing can be fastened thereto and can be conveyed about the board, the flexible member including parallel, spaced-apart end edges, and spaced-apart, parallel elastic tension members extending between the end edges at right angles thereto for tensioning the flexible members, wherein the resilient tension members apply tension over different longitudinal areas of the flexible member, compensating for the different conditions affecting the flexible member, the tension members being spaced further apart near the center of the flexible member than they are near the longitudinal edges thereof, a plurality of additional idler rollers below the board and parallel with the idler rollers at the edges of the board, the flexible member being threaded through the additional rollers whereby additional drawing surface area is provided by the flexible member.

* * * * *